US011884369B2

(12) United States Patent
Cannon et al.

(10) Patent No.: US 11,884,369 B2
(45) Date of Patent: Jan. 30, 2024

(54) INFLATABLE CONVERTIBLE PADDLE BOARD

(71) Applicant: Connelly Skis, LLC, Lynnwood, WA (US)

(72) Inventors: Douglas A. Cannon, Arlington, WA (US); Jon Donald Cottons, Lake Forest Park, WA (US)

(73) Assignee: Connelly Skis, LLC, Lynnwood, WA (US)

( * ) Notice: Subject to any disclaimer, the term of this patent is extended or adjusted under 35 U.S.C. 154(b) by 0 days.

(21) Appl. No.: 17/473,720

(22) Filed: Sep. 13, 2021

(65) Prior Publication Data

US 2022/0089256 A1 Mar. 24, 2022

Related U.S. Application Data

(60) Provisional application No. 63/082,921, filed on Sep. 24, 2020.

(51) Int. Cl.

| | |
|---|---|
| ***B63B 32/56*** | (2020.01) |
| ***B63B 32/40*** | (2020.01) |
| ***B63B 32/51*** | (2020.01) |

(52) U.S. Cl.

CPC ..... *B63B 32/56* (2020.02); *B63B 32/40* (2020.02); *B63B 32/51* (2020.02)

(58) Field of Classification Search

CPC ..... B63B 32/56; B63B 32/40; B63B 32/51; B63B 32/70

See application file for complete search history.

(56) References Cited

U.S. PATENT DOCUMENTS

| | | | | |
|---|---|---|---|---|
| 7,861,662 | B2 | 1/2011 | Rista | |
| 8,821,204 | B1 | 9/2014 | Hoge, Jr. | |
| 8,834,220 | B2 | 9/2014 | Haller et al. | |
| 9,290,245 | B2 * | 3/2016 | Bishop | B63B 32/70 |
| 9,428,253 | B1 | 8/2016 | Morgan et al. | |
| 10,086,918 | B2 | 10/2018 | Pepper et al. | |
| 10,479,458 | B2 | 11/2019 | Hall | |
| 2014/0245943 | A1 * | 9/2014 | Swan | B63B 32/40 114/345 |
| 2014/0364022 | A1 | 12/2014 | Dingel | |
| 2015/0033997 | A1 | 2/2015 | Groves et al. | |
| 2017/0197691 | A1 * | 7/2017 | Pepper | B63B 32/59 |
| 2018/0208272 | A1 * | 7/2018 | Hopkins | B32B 7/08 |
| 2018/0208279 | A1 | 7/2018 | Soren | |
| 2019/0092434 | A1 | 3/2019 | Mellina | |
| 2021/0039753 | A1 | 2/2021 | Hawthorne | |

* cited by examiner

*Primary Examiner* — Andrew Polay
(74) *Attorney, Agent, or Firm* — Perkins Coie LLP

(57) ABSTRACT

A convertible inflatable stand-up paddle board includes a main body member defining a first aperture and optionally a second aperture, and one or more panels fixed to the main body member and covering a bottom end of the apertures. A foldable seat assembly is disposed in the first aperture, and a second seat assembly is disposed in the second aperture. The seat assemblies have a seat portion and a backrest portion. The backrest portion is movable between (i) a folded position wherein a surface of the backrest portion and an upper surface of the main body member define a standing surface for the stand-up paddle board, and (ii) an upright position wherein the backrest portion extends away from the seat portion. The stand-up paddle board is thereby convertible between a stand-up configuration and a sit-down configuration.

19 Claims, 5 Drawing Sheets

INFLATABLE CONVERTIBLE PADDLE BOARD

CROSS-REFERENCE TO RELATED APPLICATION

This application claims the benefit to Provisional Application No. 63/082,921, filed Sep. 24, 2020, which is hereby incorporated by reference in its entirety.

BACKGROUND

Stand-up paddle boarding (or paddleboarding) is a popular and growing water sport in the United States and throughout the world, providing a fun water activity with excellent fitness and balance benefits. See, for example, "Stand Up Paddle Boarding: An Analysis of a New Sport and Recreational Activity," Ben Schram, Bond University Doctoral Thesis, August 2015 ("Schram"). Schram notes, " . . . the results from this research provide evidence for the anecdotal claims of the benefits for participation in this new aquatic activity of stand-up paddle boarding. Stand-up paddle boarding is associated with high levels of aerobic and anaerobic fitness, core muscle strength training, and balance. It is an enjoyable, alternative means of training with a multitude of health and fitness benefits." A conventional stand-up paddle board (SUP) is operated by a user supported on the SUP in a standing or kneeling position. In exemplary embodiments, an SUP may have a solid or rigid board construction, for example, a foam core covered by fiberglass, carbon fiber, wood veneer, or the like, or an inflatable construction typically having a drop stitch core covered by a polymeric material, for example, polyvinyl chloride. SUPs differ from surfboards in their overall dimensions and will typically have a relatively long flat rocker (longitudinal curvature) providing better gliding, tracking, and stability.

A typical SUP outing may be much longer than a typical surfboard outing. Standing or kneeling, while propelling and balancing on an SUP for a long period of time, however, can be arduous and may deter users from taking up the sport. The paddle boarder may therefore become fatigued during longer outings and desire a rest break, or an option to continue an outing from a seated position. Also, a paddle boarder may want to pause and loiter at a particular location, for example to enjoy wildlife, scenery, and/or a lunch. Prior art SUPs are not conducive to comfortably sitting on the paddle board.

An inflatable SUP is disclosed in U.S. Pat. No. 8,834,220, to Hoge, Jr., which is hereby incorporated by reference. Hoge, Jr. discloses a main body employing a high pressure drop stitch material, with a deck formed on a top portion of the body, and a molded needle nose portion providing a V-shape bow. More recently, U.S. Pat. No. 10,479,458, to Hall (hereinafter, "Hall"), which is hereby incorporated by reference, discloses an inflatable SUP with a separately inflatable U-shaped upper chamber fixed to a front end of the SUP. The chambers use a drop stitch construction "wherein two sheets of fabric (e.g., polyester woven support fabric or other suitable material) is joined by many (e.g., thousands) of threads of predetermined length(s)." (Hall at Col. 2, lines 40-45.)

Moreover, prior art SUPs are not configured to allow the user to propel the SUP from a seated position. It would be beneficial to provide an SUP that can be readily propelled by a user from a seated position as well as from a standing position and that is easily convertible between a seated configuration and a standing configuration.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A convertible inflatable stand-up paddle board is disclosed, having a main body member defining an aperture, a panel fixed to the main body member and covering a bottom end of the aperture; and a seat assembly disposed in the aperture. The seat assembly has a seat portion and a backrest portion, and the backrest portion is movable between (i) a folded position with a surface of the backrest portion and an upper surface of the main body member defining a standing surface for the stand-up paddle board, and (ii) an upright position wherein the backrest portion extends away from the seat portion.

In an embodiment the convertible stand-up paddle board includes straps that attach the seat portion to the backrest portion.

In an embodiment the convertible stand-up paddle board has a flexible panel that attaches a back end of the seat portion to the backrest portion.

In an embodiment the convertible stand-up paddle board main body member has a uniform thickness.

In an embodiment the convertible stand-up paddle board main body member is formed with a drop stitch construction.

In an embodiment the seat assembly is inflatable.

In an embodiment the first aperture comprises a square aperture with rounded corners.

In an embodiment the main body member has a second aperture and a second seat assembly disposed in the second aperture, and the second seat assembly is also movable between (i) a folded position, and (ii) an upright position.

In an embodiment the convertible stand-up paddle board includes a handle fixed to an upper surface of the main body member.

A convertible inflatable stand-up paddle board system has a body member defining a recess configured to receive a seat assembly, the seat assembly having a seat portion and a backrest portion, and the backrest portion is movable between (i) a folded position with a surface of the backrest portion and an upper surface of the main body member defining a standing surface for the stand-up paddle board, and (ii) an upright position wherein the backrest portion extends away from the seat portion.

In an embodiment the convertible stand-up paddle board has a plurality of straps that fixedly attach the seat portion to the backrest portion.

In an embodiment the convertible stand-up paddle board includes a flexible panel that attaches a back end of the seat portion to the backrest portion.

In an embodiment the convertible stand-up paddle board has a uniform thickness.

In an embodiment the seat assembly is inflatable.

In an embodiment the aperture is a square aperture with rounded corners.

In an embodiment the convertible stand-up paddle board main body member has a second aperture, and the convertible stand-up paddle board includes a second seat assembly disposed in the second aperture. For example, the second seat assembly may also be movable between (i) a folded position, and (ii) an upright position.

In an embodiment the convertible stand-up paddle board has a handle fixed to an upper surface of the main body member to facilitate transporting the paddle board.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
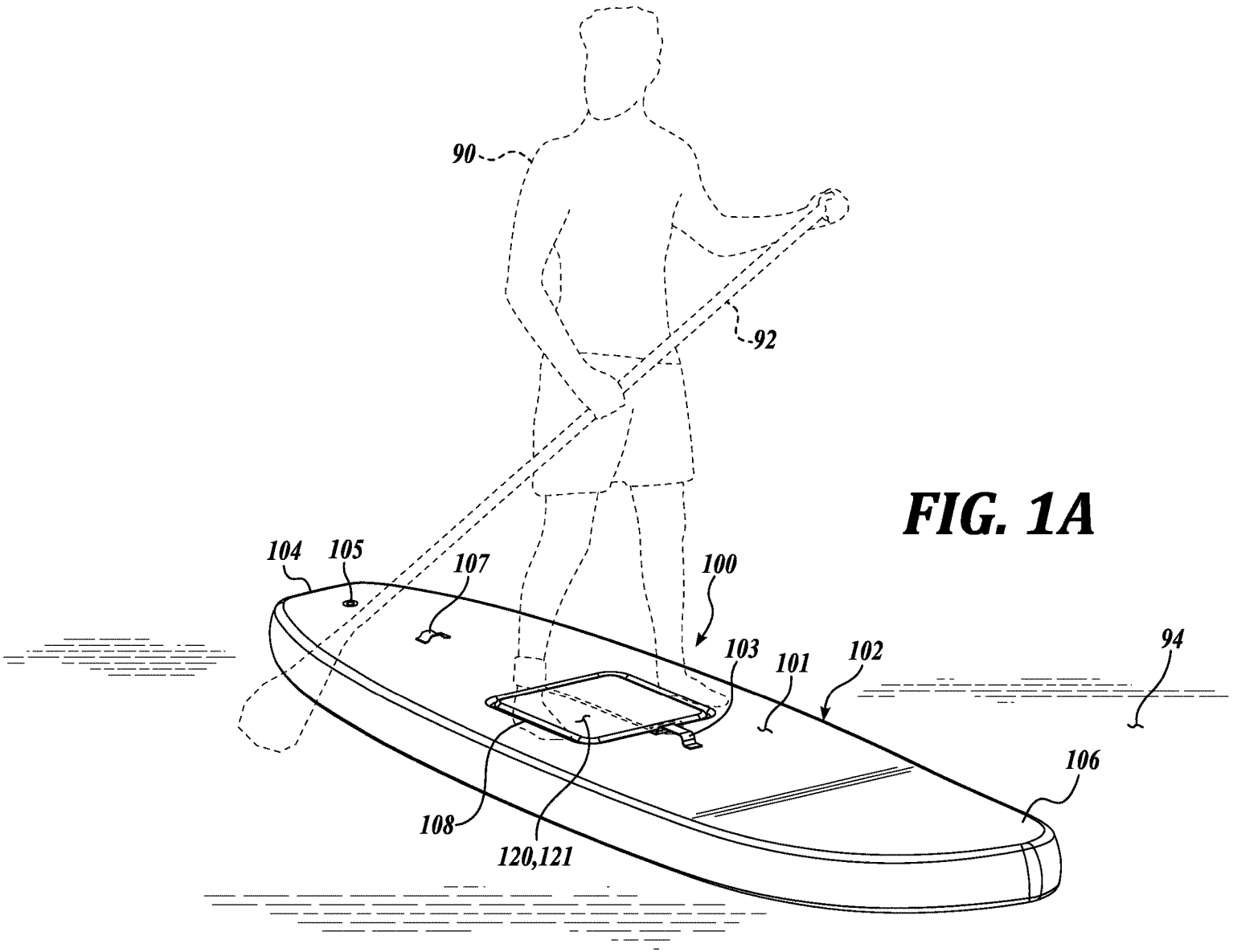
FIG. 1A is an environmental view showing an inflatable convertible paddle board having a foldable seat assembly in accordance with the present invention, with a backrest portion of the foldable seat assembly in a folded position, wherein the convertible paddle board is configured for stand-up paddle boarding.
Figure 1B:
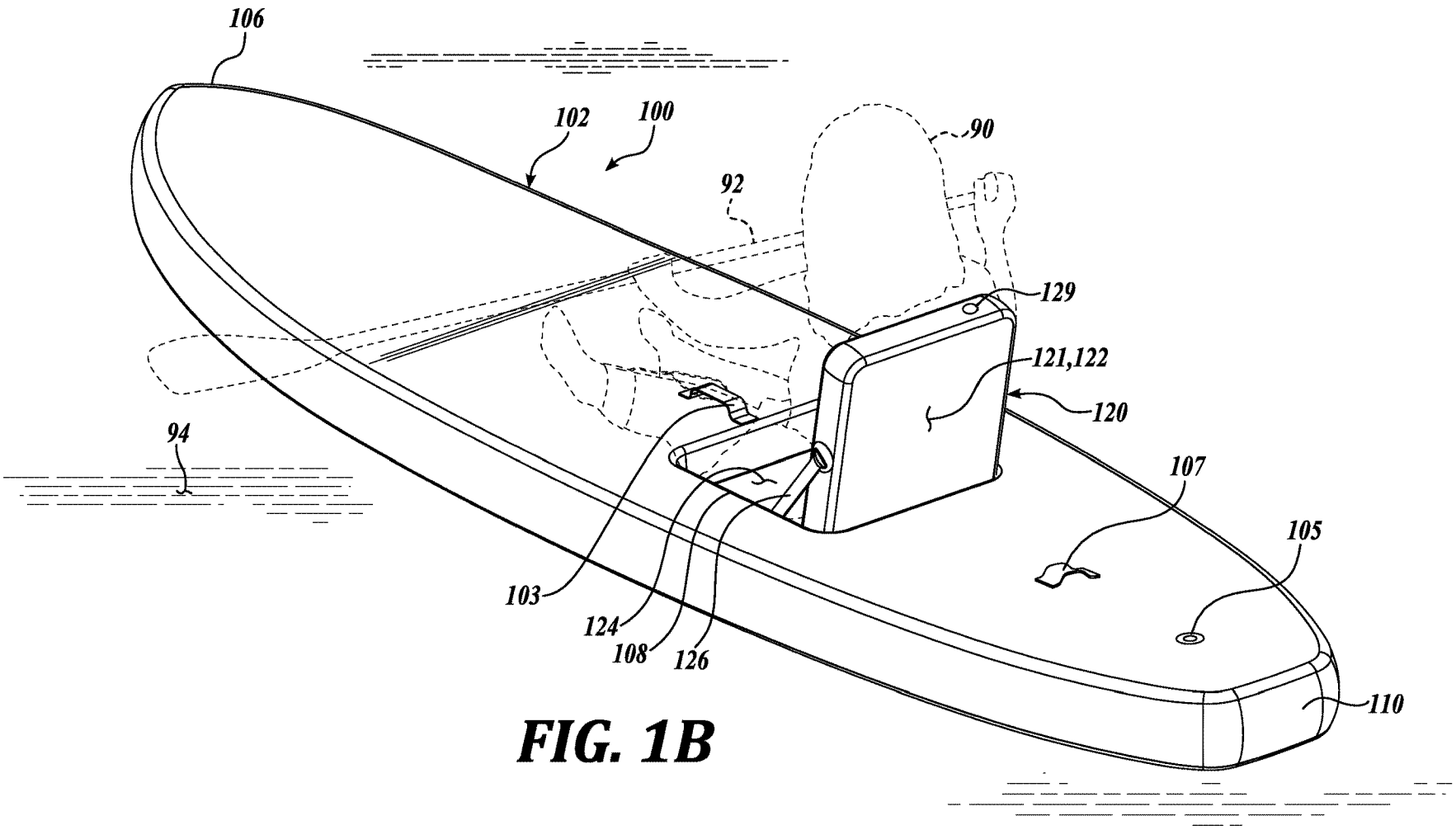
FIG. 1B is an environmental view showing the inflatable convertible paddle board shown in FIG. 1A with a backrest portion of the foldable seat is in an upright position, wherein the convertible paddle board is configured for sit-down paddle boarding.

FIGS. 1A and 1B are environmental views showing an inflatable convertible paddle board 100 in accordance with the present invention, shown floating in a body of water 94 and a user 90 shown in phantom.

FIG. 1A shows the convertible paddle board 100 in a stand-up configuration with the user 90 positioned to propel the paddle board 100 with a paddle or oar 92. The convertible paddle board 100 has an inflatable main body member 102 providing a standing platform 101. The main body member 102 has a tail end 104 and a nose end 106. Optionally, one or more handles 103 (one shown) may be provided to facilitate moving the convertible paddle board 100 to the body of water 94 and may assist the user 90 in boarding (and reboarding) the paddle board 100 during use. An inflation valve 105 provides a means for inflating and deflating the main body member 102. A lanyard connector 107, for example a through channel, a loop member, or the like, allows the user 90 to connect to the convertible paddle board 100, for example, with an ankle lanyard or the like (not shown). In a current embodiment the inflated main body member 102 has a generally uniform thickness along most or substantially all of its length, and the nose end 106 curves gently upward. In other embodiments the paddle board may have a non-uniform thickness and/or a relatively flat rocker.

The main body member 102 defines a recess 108, for example, an aperture through the main body member 102. The recess 108 in this embodiment is generally rectangular with rounded corners and is centered along a longitudinal centerline of the main body member 102. A foldable seat assembly 120 is disposed in the recess 108. In FIG. 1A the seat assembly 120 is shown in a down or folded position wherein an upper surface 121 of the seat assembly 120 may have a generally flat upper surface 121 that is substantially coplanar with the standing platform 101 portion of the main body member 102, such that the main body member 102 and the seat assembly 120 cooperatively provide a standing surface for the user 90 during use. It will be appreciated that with the foldable seat assembly 120 in the folded position the convertible paddle board 100 is operable as a conventional inflatable stand-up paddle board.

Figure 2:
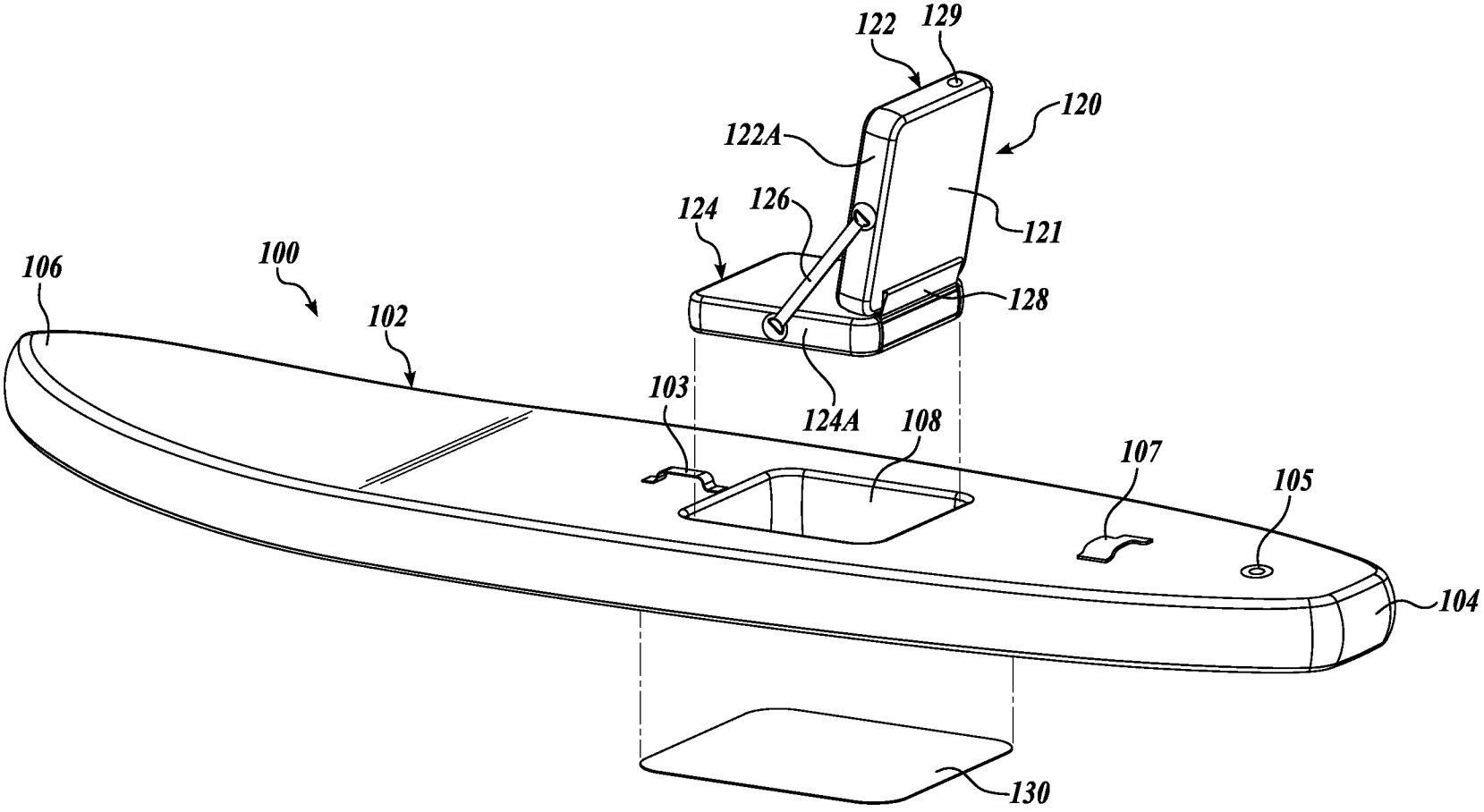
FIG. 2 is a partially exploded view of the inflatable convertible paddle board shown in FIGS. 1A and 1B.

Referring now also to FIG. 1B wherein the convertible paddle board 100 is shown configured for use in a sitting configuration. It can be seen that the foldable seat assembly 120 includes a backrest portion 122 and a seat portion 124. In FIG. 1B the backrest portion 122 is rotated to an upright position and the seat portion 124 remains in the recess 108, such that the seat assembly 120 provides a recessed seat for the user. Refer also to FIG. 2, which shows a partially exploded view of the convertible paddle board 100 with the backrest portion 124 shown in the upright position.

A pair of oppositely disposed straps 126 (one visible in FIG. 1B) connect the backrest portion 122 to the seat portion 124 of the seat assembly 120. For example, the straps 126 may have one end fixed near a middle of a generally vertical edge 122A of the backrest portion 122, and an opposite end fixed near a middle of a generally horizontal edge 124A of the seat portion 124. Optionally, the backrest portion 122 and the seat portion 124 may also connect with a panel 128 affixed along corresponding rearward edges of the backrest portion 122 and the seat portion 124.

In a current embodiment the backrest portion 122 and the seat portion 124 are also made with a drop stitch construction and include one or more inflation valves 129 (one shown) for inflating the backrest 120.

As shown in FIG. 2, in the current embodiment a retainer panel 130 is fixed to a bottom surface of the main body member 102 underlying the recess 108, sealing a bottom end of the recess 108. In an alternative embodiment the retainer panel is an integral portion of a bottom of the main body member 102.

In a currently preferred embodiment, the foldable seat assembly 120 is configured to be removable from the main body member 102. For example, in an embodiment the main body member 102 and the foldable seat assembly 120 further comprise releasable connection means, for example hook and loops fasteners, straps, adhesive panels, or the like, to releasably attach the seat assembly 120 to the main body member 102. In another embodiment the recess 108 defines an upper lip portion that has a smaller transverse dimension than other portions of the recess 108, and smaller than a corresponding transverse dimension of the seat assembly 120, such that the seat assembly is positively retained in the recess 108 by interference. In other embodiments the seat assembly is permanently affixed to the main body member 102.

Figure 3:
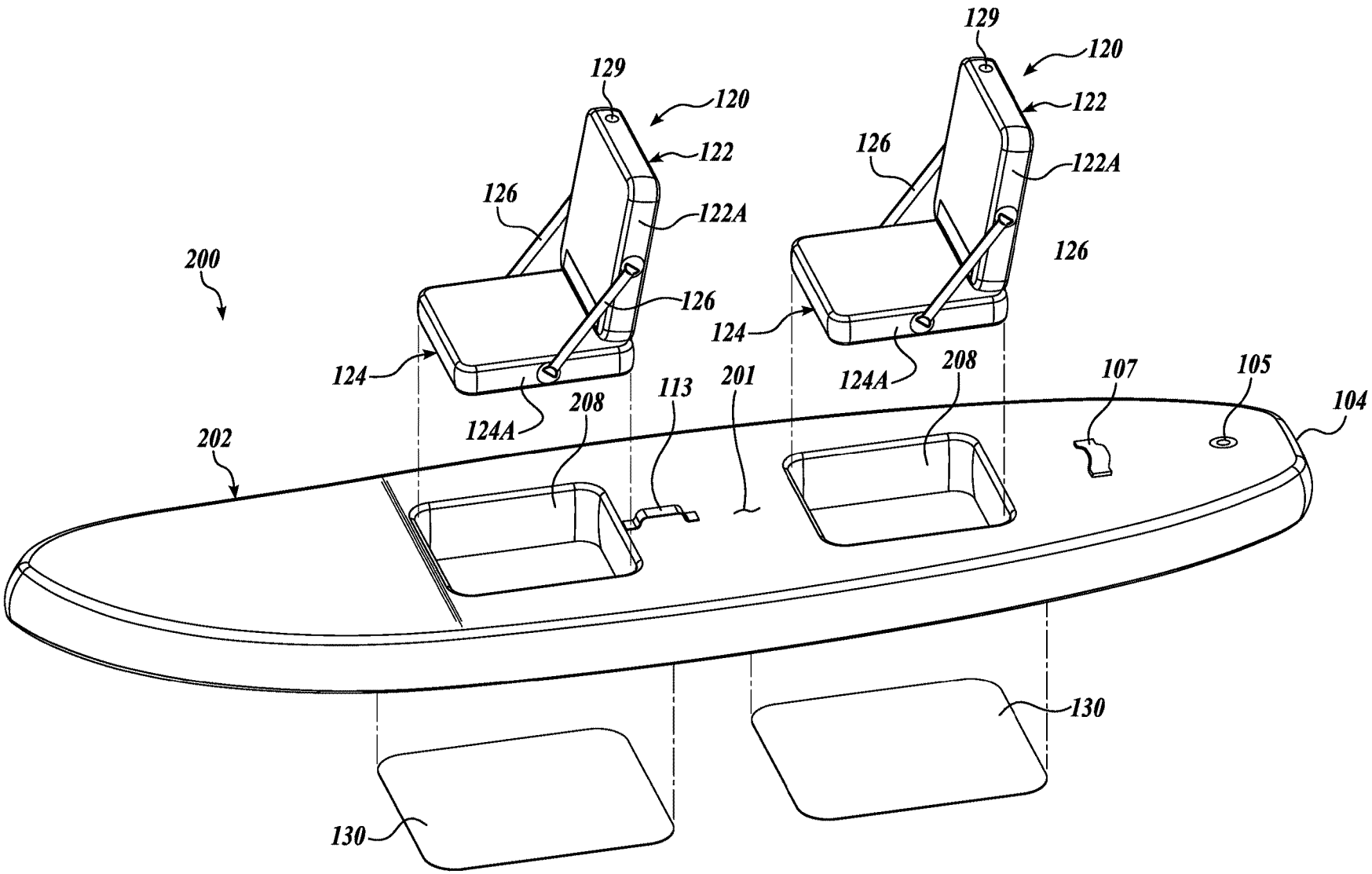
FIG. 3 is a partially exploded view of another embodiment of an inflatable convertible paddle board in accordance with the present invention, wherein the paddle board has two foldable seat assemblies, each shown in the upright position.
Figure 4:
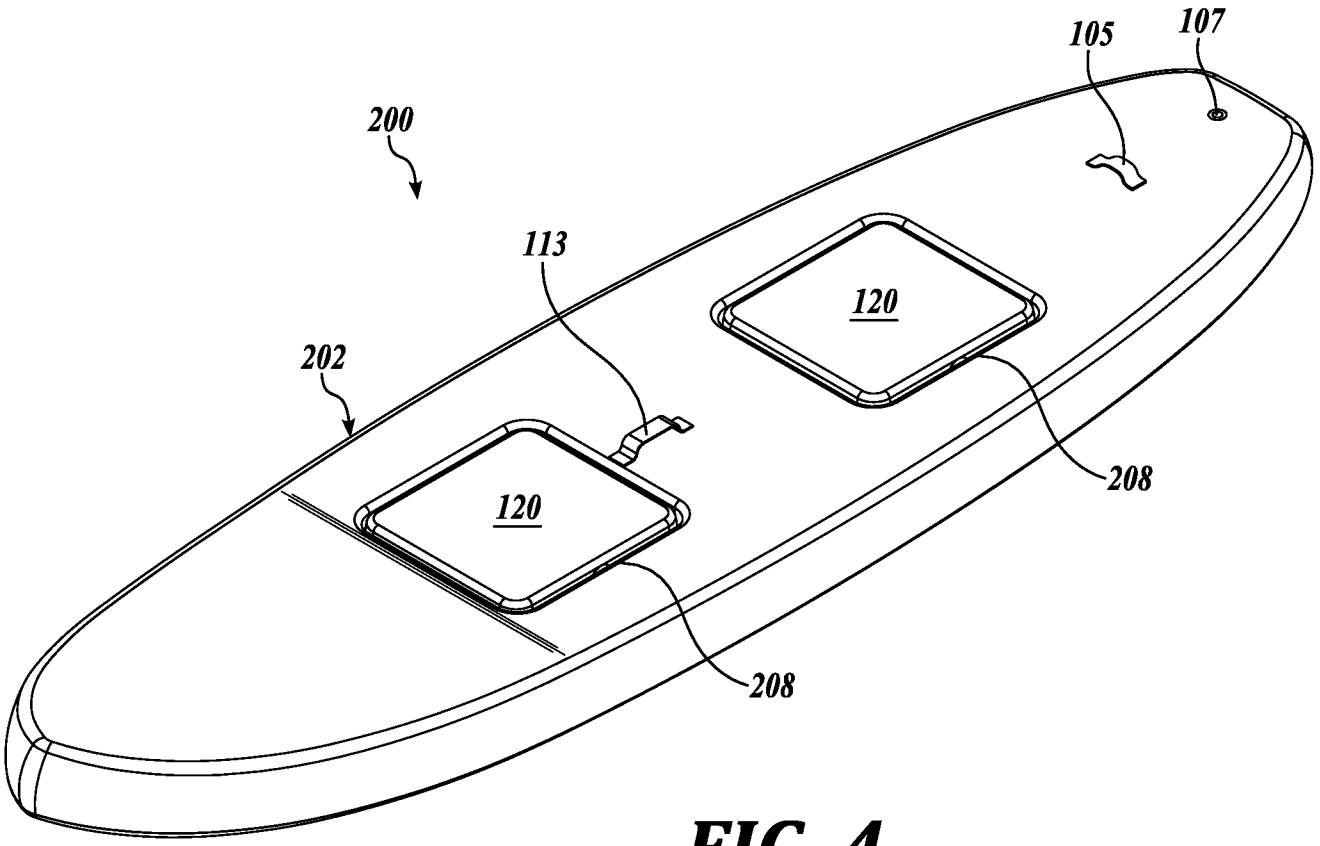
FIG. 4 is a perspective view of the inflatable convertible paddle board shown in FIG. 3 with the convertible paddle board configured for stand-up paddle boarding.

FIG. 3 is a partially exploded view of a tandem embodiment of an inflatable convertible paddle board 200 in accordance with the present invention. The convertible paddle board 200 has a main body member 202 similar to the main body member 102 described above and defining two spaced-apart recesses 208, for example, apertures that open to the standing platform 201.

Two foldable seat assemblies 120, are shown in an upright position and sized and configured to slidably engage a corresponding one of the two recesses 208 in the main body member 202. The two foldable seat assemblies 120 in the embodiment shown in FIG. 3 are interchangeable. However, it is contemplated that in other embodiments one of the foldable seat assemblies may be smaller than the other, for example, to accommodate paddle boarders of different sizes. A pair of retaining panels 216 are fixed to a bottom side of the body portion 202 and configured to retain the foldable seat assemblies 120. In other embodiments a single larger retaining panel may be provided, or a retaining panel may be integral with the main body member 202.

While illustrative embodiments have been illustrated and described, it will be appreciated that various changes can be made therein without departing from the spirit and scope of the invention.

The embodiments of the invention in which an exclusive property or privilege is claimed are defined as follows:

1. A convertible inflatable stand-up paddle board comprising:

a main body member defining a first aperture;

a panel fixed to the main body member and covering a bottom end of the first aperture; and a first seat assembly disposed in the first aperture, the first seat assembly having a seat portion and a backrest portion, wherein the backrest portion is movable between (i) a folded position wherein a surface of the backrest portion and an upper surface of the main body member define a standing surface for the stand-up paddle board, and (ii) an upright position wherein the backrest portion extends away from the seat portion, and wherein the seat portion is disposed within the first aperture such that the seat portion is positioned below the upper surface of the main body member.

2. The convertible stand-up paddle board of claim 1, further comprising at least two straps that attach the seat portion to the backrest portion.

3. The convertible stand-up paddle board of claim 2, further comprising a second panel that attaches a back end of the seat portion to the backrest portion.

4. The convertible stand-up paddle board of claim 1, wherein the main body member has a uniform thickness.

5. The convertible stand-up paddle board of claim 1, wherein the main body member is formed with a drop stitch construction.

6. The convertible stand-up paddle board of claim 1, wherein the first seat assembly is inflatable.

7. The convertible stand-up paddle board of claim 1, wherein the first aperture comprises a square aperture with rounded corners.

8. The convertible stand-up paddle board of claim 1, wherein the main body member further comprises a second aperture, and further comprising a second seat assembly disposed in the second aperture.

9. The convertible stand-up paddle board of claim 8, wherein the second seat assembly is movable between (i) a folded position, and (ii) an upright position.

10. The convertible stand-up paddle board of claim 1, further comprising a handle fixed to the upper surface of the main body member.

11. A convertible inflatable stand-up paddle board system comprising:

a body member defining a first recess configured to receive a first seat assembly, the first seat assembly having a seat portion and a backrest portion, wherein the backrest portion is movable between (i) a folded position wherein a surface of the backrest portion and an upper surface of the body member define a standing surface for the stand-up paddle board, and (ii) an upright position wherein the backrest portion extends away from the seat portion, and wherein the seat portion is positioned within the first recess below the upper surface of the body member.

12. The convertible stand-up paddle board of claim 11, further comprising a plurality of straps that fixedly attach the seat portion to the backrest portion.

13. The convertible stand-up paddle board of claim 11, further comprising a second panel that attaches a back end of the seat portion to the backrest portion.

14. The convertible stand-up paddle board of claim 11, wherein the body member has a uniform thickness.

15. The convertible stand-up paddle board of claim 11, wherein the first seat assembly is inflatable.

16. The convertible stand-up paddle board of claim 11, wherein the first recess comprises a square aperture with rounded corners.

17. The convertible stand-up paddle board of claim 11, wherein the body member further comprises a second aperture, and further comprising a second seat assembly disposed in the second aperture.

18. The convertible stand-up paddle board of claim 17, wherein the second seat assembly is movable between (i) a folded position, and (ii) an upright position.

19. The convertible stand-up paddle board of claim 11, further comprising a handle fixed to the upper surface of the body member.

* * * * *